US012208943B2

(12) United States Patent
Nakamura et al.

(10) Patent No.: US 12,208,943 B2
(45) Date of Patent: Jan. 28, 2025

(54) PACKAGES FOR PHARMACEUTICAL PRODUCTS AND METHODS OF ASSEMBLY

(71) Applicant: AMGEN INC., Thousand Oaks, CA (US)

(72) Inventors: James Nakamura, Monterey Park, CA (US); Todd J. Manley, Oxnard, CA (US); Trevor Raymond Lowe, Ventura, CA (US); Jasmine Malvar, Woodland Hills, CA (US); Kenneth Tan, Canoga Park, CA (US)

(73) Assignee: AMGEN INC., Thousand Oaks, CA (US)

( * ) Notice: Subject to any disclaimer, the term of this patent is extended or adjusted under 35 U.S.C. 154(b) by 139 days.

(21) Appl. No.: 17/760,819

(22) PCT Filed: Oct. 6, 2020

(86) PCT No.: PCT/US2020/054392

§ 371 (c)(1),
(2) Date: Mar. 16, 2022

(87) PCT Pub. No.: WO2021/071831

PCT Pub. Date: Apr. 15, 2021

(65) Prior Publication Data

US 2022/0340326 A1 Oct. 27, 2022

Related U.S. Application Data

(60) Provisional application No. 62/911,554, filed on Oct. 7, 2019.

(51) Int. Cl.
*B65D 5/50* (2006.01)
*B65B 5/04* (2006.01)
(Continued)

(52) U.S. Cl.
CPC ..... *B65D 5/5059* (2013.01); *B65B 5/04* (2013.01); *B65B 5/06* (2013.01); *B65B 55/00* (2013.01)

(58) Field of Classification Search
CPC .. B65D 5/5038; B65D 5/5052; B65D 5/5057; B65D 5/5059; B65D 5/5286;
(Continued)

(56) References Cited

U.S. PATENT DOCUMENTS 6,158,589 A * 12/2000 Smith ..... B65D 5/5028 206/466
6,675,973 B1 * 1/2004 McDonald ..... B65D 5/5028 206/583
(Continued)

FOREIGN PATENT DOCUMENTS

CN 206827107 U 1/2018
CN 108045693 A 5/2018
(Continued)

OTHER PUBLICATIONS https://www.sealedair.com/products/protective-packaging/korrvu-suspension-retention-packaging <https://protect-us.mimecast.com/s/kAEmCn5GDwTGpG6lh9aobH>, brochure downloaded Sep. 8, 2020.
(Continued)

*Primary Examiner* — Anthony D Stashick
*Assistant Examiner* — Marcos Javier Rodriguez Molina
(74) *Attorney, Agent, or Firm* — MARSHALL, GERSTEIN & BORUN LLP

(57) ABSTRACT

A package for a pharmaceutical product and method of assembly is described that includes a subassembly with a body including a main panel and legs depending downwardly from opposite edges of the main panel, and a sheet of plastic having opposite ends fixed to the body with the sheet of plastic at least partially extending over the main panel. The sheet of plastic is configured to be tensioned over and deformed around one or more primary containers to hold the one or more primary containers in place relative to the main panel of the body.

16 Claims, 6 Drawing Sheets

(51) Int. Cl.

| | |
|---|---|
| ***B65B 5/06*** | (2006.01) |
| ***B65B 55/00*** | (2006.01) |
| *B65D 77/04* | (2006.01) |
| *B65D 81/07* | (2006.01) |

(58) Field of Classification Search

CPC .. B65D 81/075; B65D 23/0885; B65D 25/14; B65D 2590/005; B65D 71/0085; B65D 75/002; B65D 75/36; B65D 75/366; B65D 75/368; B65D 79/02; B65D 81/052; B65D 81/3827; B65D 85/00; B65D 90/0046; B65D 90/0053; B65D 5/5028; B65D 77/042; B65B 23/00; B65B 3/003; B65B 3/006; B65B 31/00; B65B 31/027; B65B 55/08; B65B 55/10; B65B 7/28; B65B 7/2821; B65B 5/04; B65B 5/06; B65B 55/00

USPC ..... 53/131.1, 410, 411, 415, 426, 428, 473; 215/230, 274, 309; 221/170; 222/1, 71, 222/83, 173, 192, 321.6, 385, 386, 394, 222/395, 566, 630; 206/205, 232, 363, 206/364, 365, 438, 459.5, 461, 497, 206/524.1, 524.3, 524.6, 525, 528, 534, 206/569, 570, 571

See application file for complete search history.

(56) References Cited

U.S. PATENT DOCUMENTS

| | | | | |
|---|---|---|---|---|
| 8,727,123 | B1 * | 5/2014 | Roberts | B65D 81/075 206/583 |
| 2010/0320112 | A1 * | 12/2010 | Kasiwabara | B65D 5/5028 206/461 |
| 2011/0240515 | A1 * | 10/2011 | Ridgeway | B65D 5/5028 53/472 |
| 2012/0272620 | A1 * | 11/2012 | McDonald | B65D 5/5028 206/583 |
| 2013/0048533 | A1 * | 2/2013 | McDonald | B65D 5/5021 206/591 |
| 2013/0233752 | A1 * | 9/2013 | Hammerschmidt | B65D 5/5028 53/467 |
| 2014/0183097 | A1 * | 7/2014 | LeRoy | B65D 81/05 206/583 |
| 2014/0246352 | A1 * | 9/2014 | Roberts | B65D 81/075 206/583 |
| 2015/0266642 | A1 * | 9/2015 | McDonald | B65D 5/5028 493/379 |
| 2017/0247163 | A1 * | 8/2017 | Ridgeway | B65D 5/5028 |
| 2018/0229883 | A1 * | 8/2018 | Lun | B65D 5/5028 |

FOREIGN PATENT DOCUMENTS

| | | | | | |
|---|---|---|---|---|---|
| CN | 207482390 | U | | 6/2018 | |
| DE | 20217626 | U1 | | 1/2003 | |
| DE | 202004011079 | U1 | | 9/2004 | |
| DE | 102004024383 | A1 | * | 12/2005 | B65D 5/5028 |
| JP | 2006096380 | A | * | 4/2006 | B65D 5/50 |
| JP | 2007039052 | A | * | 2/2007 | B65D 81/07 |
| WO | WO-1989008064 | | * | 9/1989 | B65D 81/075 |
| WO | WO1989008064 | A1 | * | 9/1989 | B65D 81/075 |

OTHER PUBLICATIONS

Written Opinion of the International Searching Authority, issued to International Application No. PCT/US2020/054392, dated Dec. 14, 2020.

International Search Report, issued to International Application No. PCT/US2020/054392, dated Dec. 14, 2020.

European Patent Application No. 20797919.6, Communication Pursuant to Article 94(3) EPC, dated Oct. 23, 2024.

* cited by examiner

PACKAGES FOR PHARMACEUTICAL PRODUCTS AND METHODS OF ASSEMBLY

CROSS-REFERENCE TO RELATED APPLICATION

This is the United States national phase of International Patent Application No. PCT/US20/54392, filed Oct. 6, 2020, which application claims the priority benefit of U.S. Provisional Application No. 62/911,554, filed Oct. 7, 2019, the entire contents of each of which are hereby incorporated by reference herein.

FIELD OF THE DISCLOSURE

The present disclosure relates to packages and, more particularly, packages for pharmaceutical products.

BACKGROUND

Pharmaceutical and biotech companies often have product portfolios with many different products that are being developed in a pipeline. These products often incorporate primary containers of various shapes and sizes, including vials. If each specific product and/or application of the same requires individual packaging, it may result in an undesirably high number of different combinations of packaging components, such as different cartons, trays, leaflets, labels, and carton closure labels with separate design, development, qualification, and implementation. This coupled with the excessive space each component may require for storage can result in a high holding inventory cost.

The present disclosure sets forth packages embodying advantageous alternatives to existing packages for primary containers, and that may address one or more of the challenges or needs mentioned herein.

SUMMARY

In accordance with a first aspect, a package for a pharmaceutical product is disclosed that includes a subassembly, where the subassembly includes a body having a main panel and legs depending downwardly from opposite edges of the main panel and a sheet of plastic having opposite ends fixed to the body with the sheet of plastic at least partially extending over the main panel. The sheet of plastic is configured to be tensioned over and deformed around one or more primary containers to hold the one or more primary containers in place relative to the main panel of the body.

In some forms, the legs can be pivotably coupled to the main panel, such that the body has a flat, storage configuration. In additional forms, the main panel can define an opening extending therethrough; and the sheet of plastic can extend over the opening.

In further forms, the body and the sheet of plastic can be a support of the subassembly, where the subassembly includes two supports. The supports can be configured to be coupled together with the main panels extending along one another such that the one or more primary containers are disposed within the openings defined in the main panels and trapped between the sheets of plastic. The bodies of the supports can also each include a wing extending from the main panel having a tab portion, and a slot opening, such that the supports can be configured to interlock with the tab portion of one configured to be inserted into slot opening of the other. If desired, the legs can include proximal and distal portions pivotable with respect to one another with the distal portions pivoted under the main panel in an assembled configuration, and the slot opening can extend through the distal portion.

In yet further forms, the subassembly can be a first subassembly and the package can further include a second subassembly, where the first and second subassemblies have different longitudinal lengths configured for primary containers having different sizes.

In any of the above forms, the package can further include an outer carton that is sized to receive the subassembly or the first and second subassemblies therein, where the legs of the subassembly or subassemblies are configured to engage the outer carton to suspend the primary containers in an interior of the outer carton.

In some forms, the ends of the sheet of plastic can be fixed to the legs, and the legs can be pivotably attached to main panel, such that pivoting the legs tensions the sheet of plastic over the main panel to hold the one or more primary containers in place relative to the main panel of the body.

In further forms, the main panel can have an unbroken configuration, such that pivoting the legs tensions the sheet of plastic over the main panel to hold the one or more primary containers in place against the main panel. In these forms, the legs can be a first pair of legs pivotably coupled to side edges of the main panel, the body can include a second pair of legs pivotably coupled to end edges of the main panel. The package can include an outer carton, where the first and second pairs of legs extend in opposite directions to engage the outer carton to suspend the one or more primary containers in an interior of the outer carton.

In other forms, the legs can be a first pair of legs pivotably coupled to side edges of the main panel, the body can include a second pair of legs pivotably coupled to end edges of the main panel, the main panel can define an opening extending therethrough, and the subassembly can include a second sheet of plastic having opposite ends fixed to the second pair of legs. The first and second sheets of plastic extend on opposite sides of the main panel, such that the first and second pairs of legs are configured to pivoted towards opposite sides of the main panel to tension the first and second sheets over the main panel and trap the one or more primary containers within the opening defined in the main panel between the first and second sheets of plastic. The package can include an outer carton, where the first and second pairs of legs extend in opposite directions to engage the outer carton to suspend the one or more primary containers in an interior of the outer carton In accordance with a second aspect, a method of assembly of a package for a pharmaceutical product is described that includes providing two supports of a subassembly of the package, each of the supports including: a body including a main panel having an opening extending therethrough and legs depending downwardly from opposite edges of the main panel; and a sheet of plastic having opposite ends fixed to the body with the sheet of plastic extending over the opening of the main panel. The method further includes disposing one or more primary containers on the sheet of plastic of one of the supports aligned within the opening of the main panel, and coupling the two supports together with the main panels extending along one another such that the one or more primary containers are disposed within the openings defined in the main panels and trapped between the sheets of plastic.

In some forms, the bodies of the supports can each include a wing extending from the main panel having a tab portion, and a slot opening, and coupling the two supports together can include interlocking the supports by inserting the tab portion of one of the supports into slot opening of the other of the supports. In further forms, the legs can include proximal and distal portions pivotable with respect to one another, where the distal portion includes the slot opening; and the method can include pivoting the distal portions of the legs to extend toward the main panel.

In any of the above forms, the method can include inserting the subassembly into an outer carton of the package so that the legs engage the outer carton to suspend the one or more primary containers in an interior of the outer carton.

In further forms, the method can include providing two supports of a second subassembly of the package, each of the supports comprising: a body including a main panel having an opening extending therethrough and legs depending downwardly from opposite edges of the main panel, and a sheet of plastic having opposite ends fixed to the body with the sheet of plastic extending over the opening of the main panel; disposing one or more primary containers on the sheet of plastic of one of the supports of the second subassembly aligned within the opening of the main panel; and coupling the two supports of the second subassembly together with the main panels extending along one another such that the one or more primary containers are disposed within the openings defined in the main panels and trapped between the sheets of plastic. In these forms, the method can include inserting the second subassembly into the outer carton of the package so that the legs engage the outer carton to suspend the one or more primary containers in an interior of the outer carton.

In accordance with a third aspect, a method of assembly of a package for a pharmaceutical product is described that includes providing a subassembly of the package, the subassembly comprising: a body including a main panel and legs depending downwardly from opposite edges of the main panel, and a sheet of plastic having opposite ends fixed to the legs with the sheet of plastic extending at least partially over the main panel; disposing one or more primary containers between the sheet of plastic and the main panel with the legs in a loading position; and pivoting the legs to a storage position depending downwardly from the main panel to tension the sheet of plastic over the main panel to hold the one or more primary containers in place relative to the main panel of the body.

In some forms, the main panel can have an unbroken configuration, such that pivoting the legs tensions the sheet of plastic over the main panel to hold the one or more primary containers in place against the main panel. In other forms, the legs can be a first pair of legs pivotably coupled to side edges of the main panel, the body can include a second pair of legs pivotably coupled to end edges of the main panel, the main panel can define an opening extending therethrough, and the subassembly can include a second sheet of plastic having opposite ends fixed to the second pair of legs. The first and second sheets of plastic extend on opposite sides of the main panel, such that the method can include pivoting the second pair of legs to a storage position extending upwardly from the main panel to tension the second sheet of plastic over the main panel to trap the one or more primary containers within the opening defined in the main panel between the first and second sheets of plastic. In any of these forms, the method can include inserting the subassembly into an outer carton.

The method of any of the above forms can further include storing the subassembly in a flat configuration.

DETAILED DESCRIPTION

Figure 1:
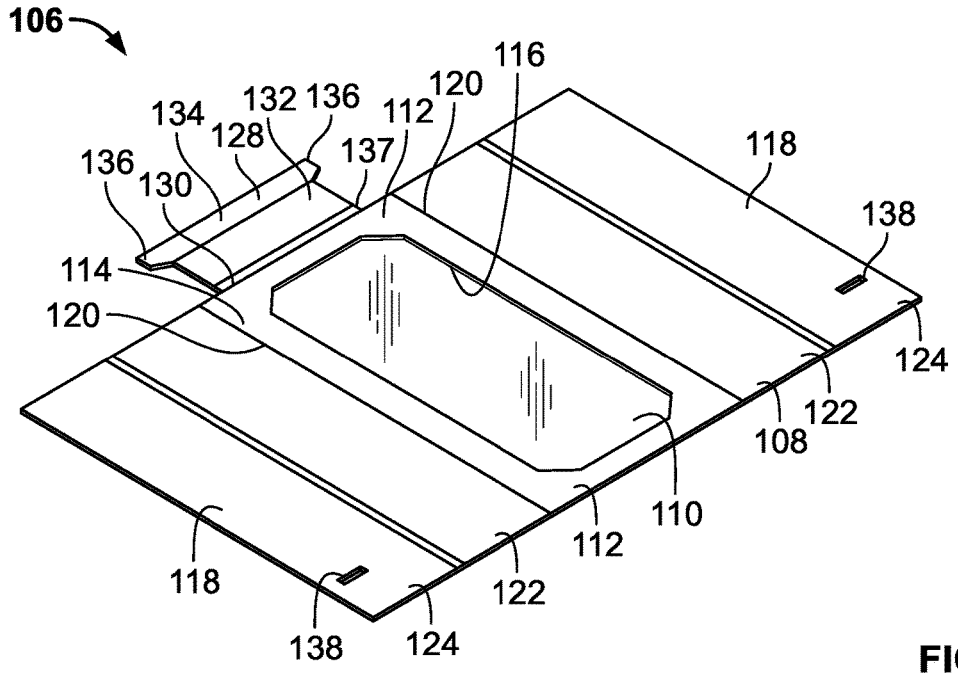
FIG. 1 is a perspective view of a first example part of a subassembly for a package in a flat, storage configuration.
Figure 2:
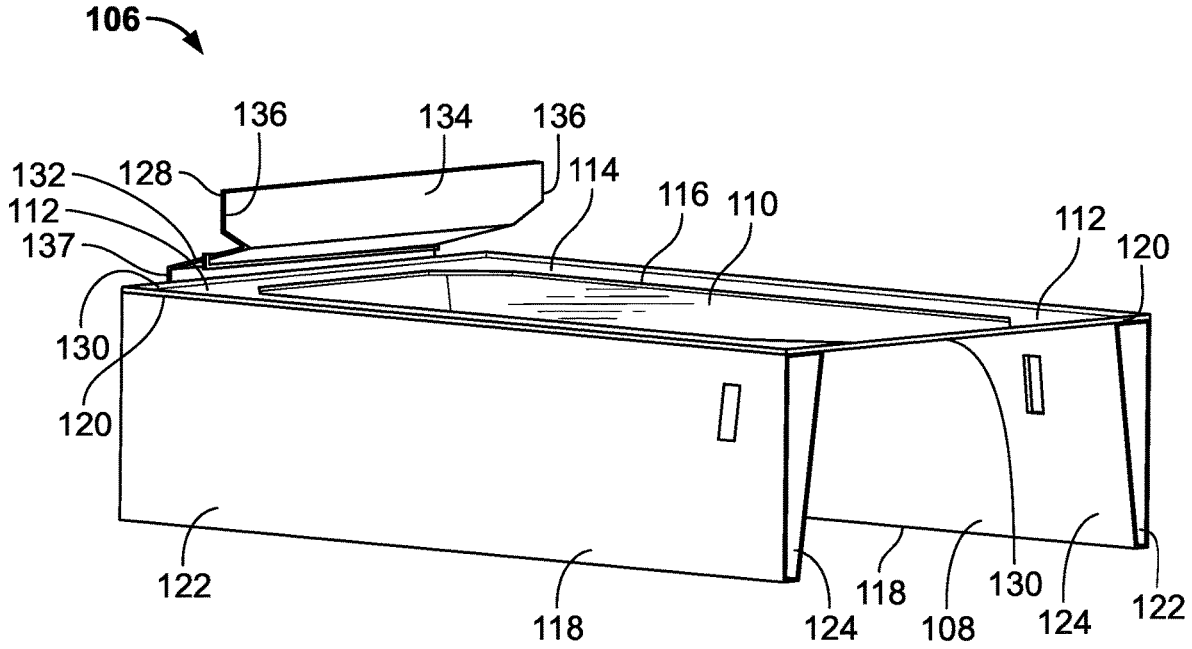
FIG. 2 is a perspective view of the part of the subassembly of FIG. 1 in an assembled configuration.

A modular secondary package system is described herein useful to protect and contain a primary container and/or communicate relevant information regarding a pharmaceutical product. The package system is capable of packaging a wide variety of one or more primary containers. The modular package system can also have a flat configuration for storage. This allows for low holding inventory and faster response to increased production volume because a singular system can be used rather than bespoke trays for each potential combination or new primary container.

The package system is composed of fiberboard and plastic sheeting, which allows for a singular packaging solution to span across various combinations of different primary containers and/or other components of a drug delivery system, such as vials, pre-filled syringes, pre-filled cartridges, empty syringe barrels, plungers, stoppers, needle(s), or any other components that may be utilized in delivering a medicament to a patient, which will henceforth be included in the definition of a primary container. The packaging system utilizes a flexible, modular packaging solution, that anchors the primary container(s) with a sheet of plastic sheeting placed in a tensioned state during assembly or suspends the primary container(s) between sheets of clear plastic sheeting placed in a tensioned state during assembly. This safely packages the contents by supporting or suspending the primary containers within an open void inside of an outer carton.

First and second examples of a package 100, 100' suitable for a pharmaceutical product are shown in FIGS. 1-9. The package 100 of these forms includes a subassembly 102 and an outer box carton 104 sized to receive the subassembly 102 therein. The subassembly 102 includes two supports 106, which can have identical configurations, as shown. Each of the supports 106 includes a body 108 and a sheet of plastic 110 having ends 112 fixed to the body 108. For example, the ends 112 can be adhered to the body 108, secured with fasteners, clamped, or other suitable mechanisms.

Referring to FIGS. 1, 2, 6, and 7, the body 108 includes a main panel 114 having an opening 116 defined therein and a pair of legs 118 extending outwardly from opposing side edges 120 of the main panel 114. In this form, the ends 112 of the sheet of plastic 110 are fixed to the main panel 114 with the sheet 110 extending over the opening 116. For example, the main panel 114 and the sheet of plastic 110 can have the same or a similar footprint. As shown, the main panel 114 has a rectangular configuration with the opening 116 spaced inwardly from perimeter edges thereof. Moreover, if desired, sides of the sheet 110 or an entire perimeter of the sheet 110 can be fixed to the main panel 114. The legs 118 are pivotably attached to the side edges 120 of the main panel 114 and include proximal and distal portions 122, 124 that are pivotable with respect to one another with the proximal portion 122 disposed between the main panel 114 and the distal portion 124.

Figure 3:
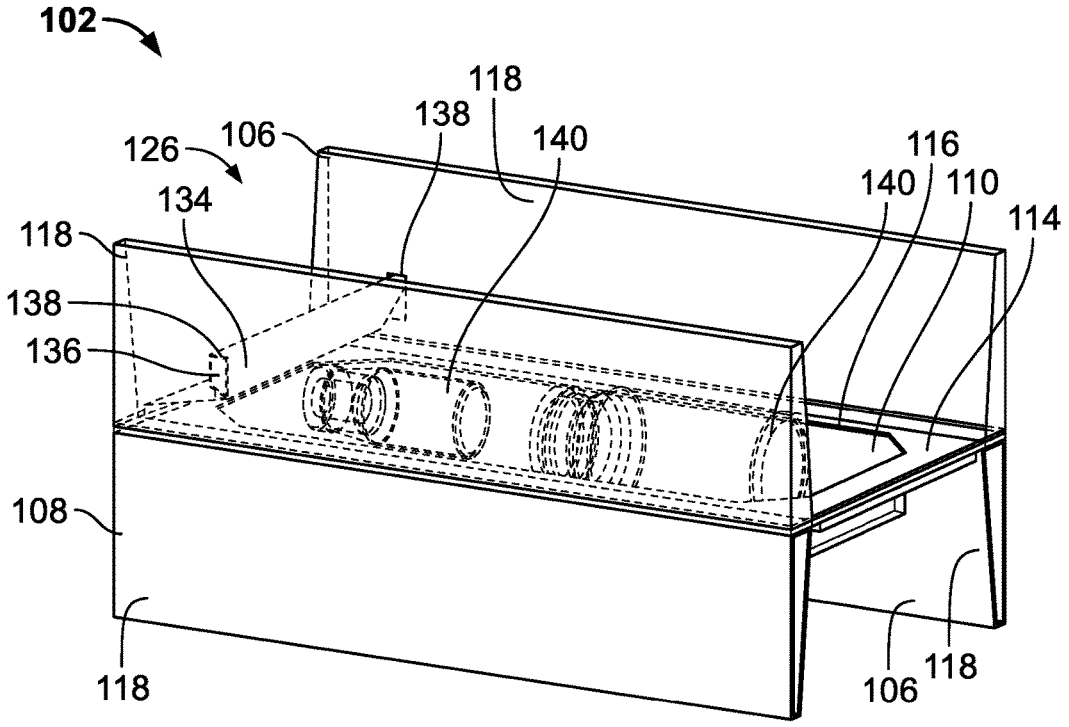
FIG. 3 is a perspective view of a first example subassembly formed from two of the subassembly parts of FIG. 2 in an interlocked configuration with primary container(s) stored therein.

The supports 106 are configured to be coupled together with the main panels 114 thereof extending along one another as shown in FIG. 3. In the illustrated form, the supports 106 couple together with an interlocking male and female connection 126, of course other suitable connection mechanisms can alternatively be utilized, such as adhesive, clamps, tongue-and-groove, and so forth. As shown, the body 108 includes a wing 128 that is pivotably connected to one of opposing end edges 130 of the main panel 114. The wing 128 includes proximal and distal portions 132, 134 with the distal portion 134 having lateral tabs 136 that extend outwardly therefrom. In one form, the wing 128 can further include an offset portion 137 sized to correspond with a thickness of the main panel 114, so that when the supports 106 are joined together, as discussed below, the proximal portion 132 of the wing 128 can extend along the main panel 114. Further, the legs 118 include slot openings 138 that are configured to receive the lateral tabs 136 of the other support 106 therein to provide the connection 126 and interlock the two supports 106. As shown, the slot openings 138 are disposed through the distal portions 124 of the legs 118 adjacent to an opposite end of the body 108 relative to the wing 128.

Advantageously, with this configuration, the package 100, including the subassembly 102 and the outer carton 104, can be stored in a flat configuration with the legs 118 and wing 128 extending outwardly from the main panel 114 and the outer carton 104 disassembled until assembly is needed. Thereafter, a user can pivot the legs 118 so that the proximal portion 122 extends downwardly away from the main panel 114 and the distal portion 124 extends back toward and underneath the main panel 114 along an interior of the distal portion 124. This configuration disposes the slot openings 138 across from one another adjacent to the main panel 114. Thereafter, the user can place one or more one or more primary containers 140 on the sheet of plastic 110 aligned over the opening 116 in the main panel 114. Next, the user can place the second support 106 on the first support 106 with the main panels 114 aligned and facing one another. As the main panels 114 are brought together, the sheets of plastic 110 deform around the primary containers 140 and extend through the openings 116. After the main panels 114 are fully brought together and the sheets of plastic 110 are holding the primary containers 140 in place within the openings 116 relative to the main panel 114, the user can pivot the wing 128 of each support 106 around the main panel 114 of the other support 106, and insert the lateral tabs 136 of the wings 128 into the slot openings 138 of the other support 106. With both wings 128 interlocked to the other support 106, the supports 106 are interlocked and the subassembly 102 is assembled with the primary containers 140 stored therein. Thereafter, the outer carton 104 can be assembled and the subassembly 102 can be inserted into the outer carton 104. As shown, the outer carton 104 can be sized so that the legs 118 of both supports 106 combined to extend fully between and engage walls 142 of the outer carton 104 so that the primary containers 140 are securely suspended within the interior of the outer carton 104 with the legs 118 bracing the carton 104 internally. As shown, the legs 118 are sized to provide headspace within the outer carton 104 both above and below the primary containers 140 with the space from the walls 142 of the outer carton 104 providing additional protection for the primary containers 140. In one example, the outer carton 104 can include end flaps 144 that can be pivoted to close off open ends 146 defined by the walls 142 of the carton 104 as commonly understood. If desired, an outsert or pamphlet 148 having information regarding the primary containers 140 or other identification information thereon, can be inserted into the outer carton 104 along with the subassembly 102.

Figure 4:
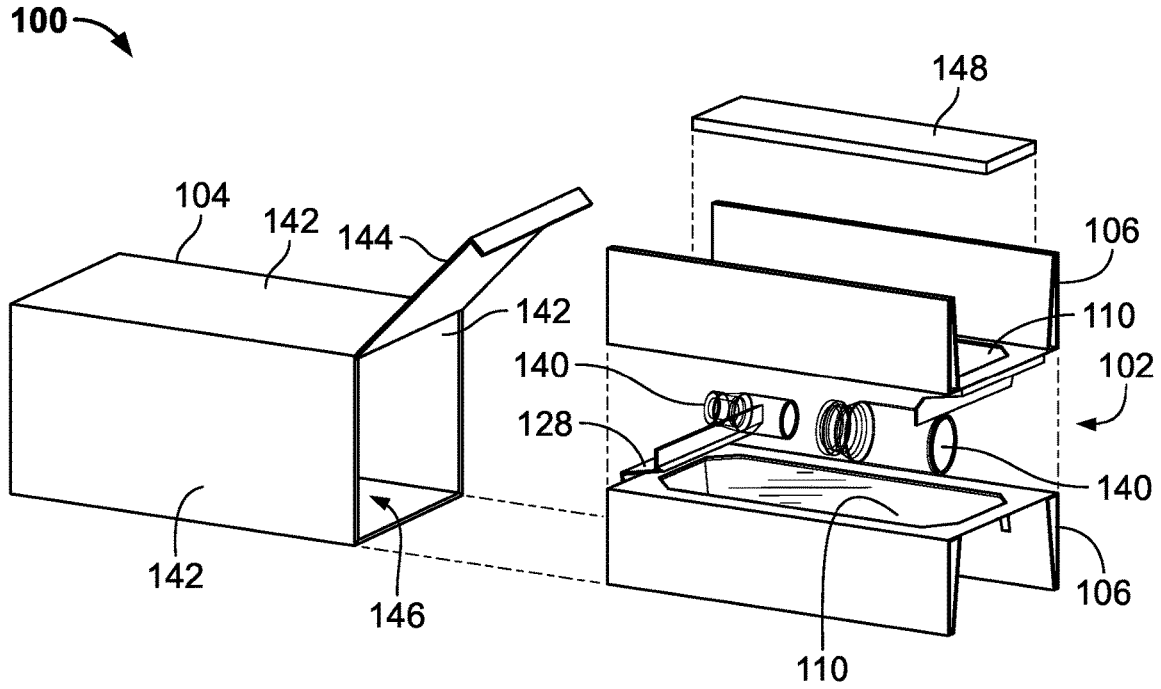
FIG. 4 is an exploded view of a first example package including the subassembly of FIG. 3 and an outer carton.
Figure 5:
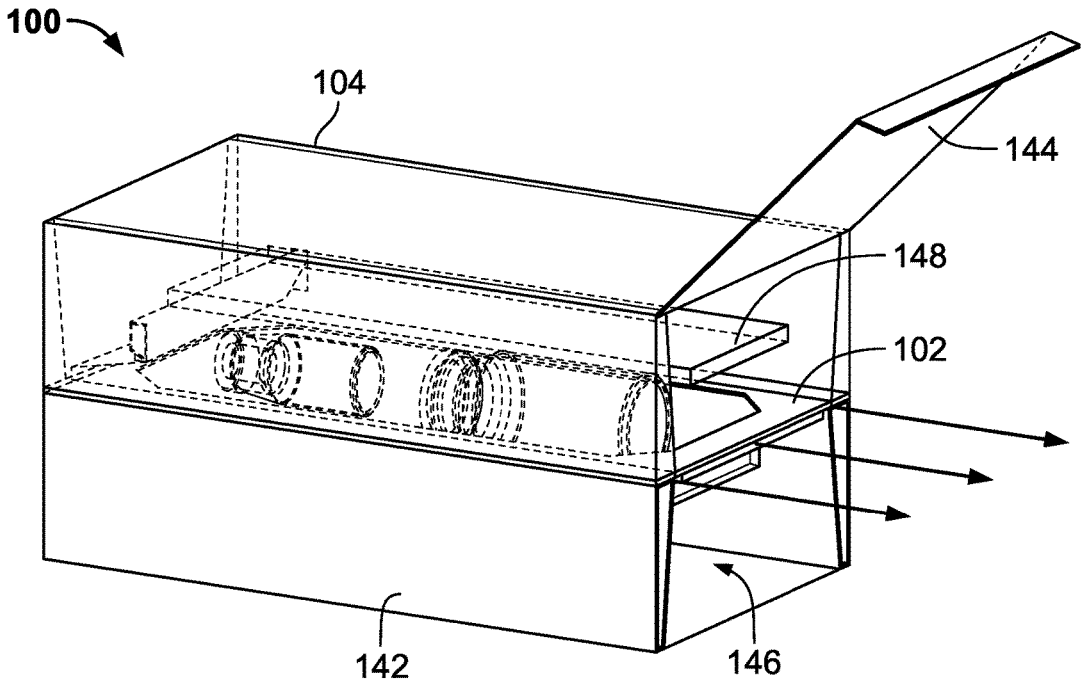
FIG. 5 is a perspective view of the package of FIG. 4.
Figure 6:
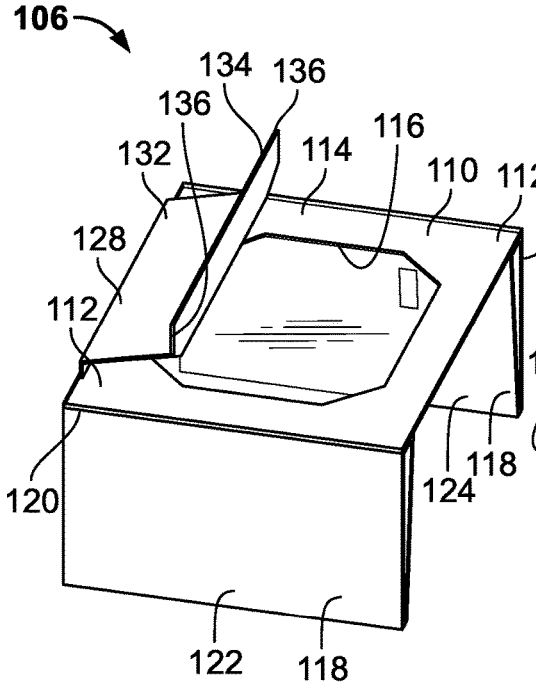
FIG. 6 is a perspective view of a second example part of a subassembly for a package in an assembled configuration.
Figure 7:
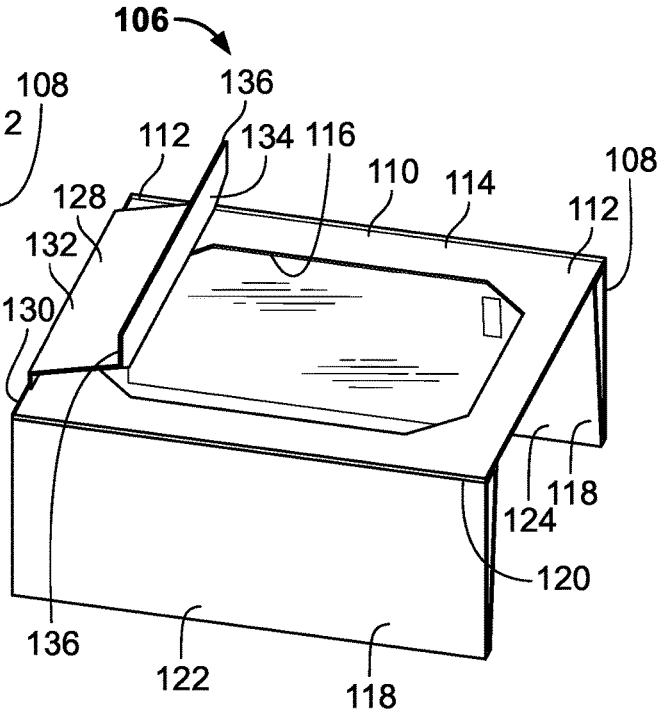
FIG. 7 is a perspective view of a third example part of a subassembly for a package in an assembled configuration.
Figure 8:
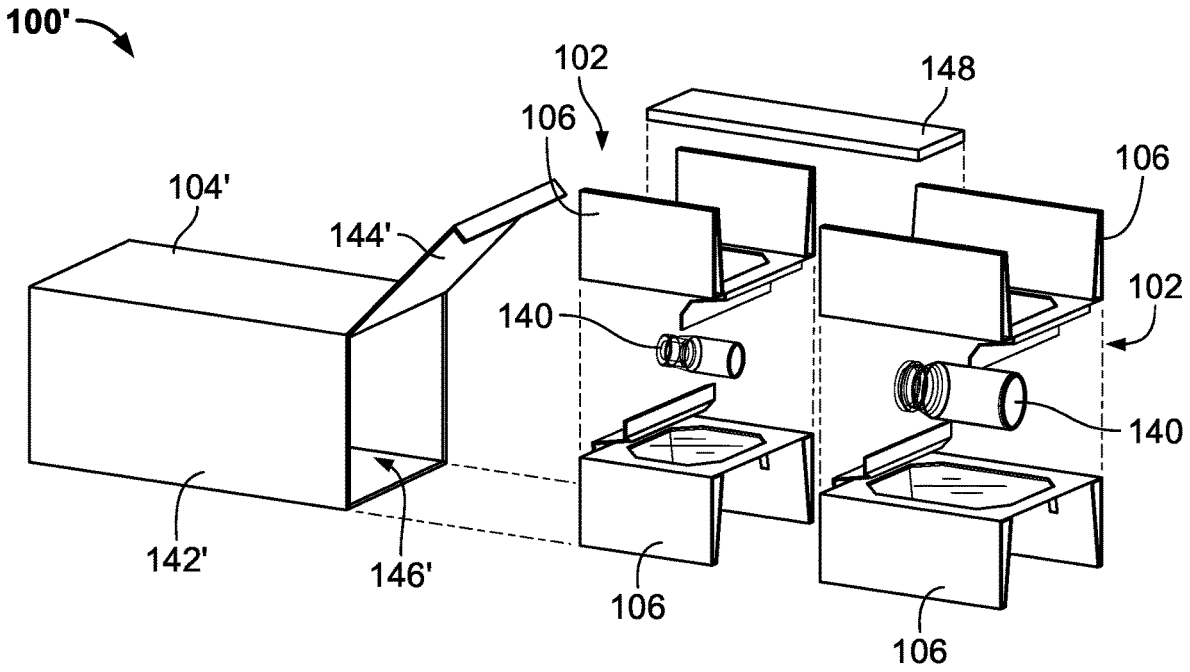
FIG. 8 is an exploded view of a second example package including a subassembly formed from two of the subassembly parts of FIG. 6, a subassembly formed from two of the subassembly parts of FIG. 7, and an outer carton.
Figure 9:
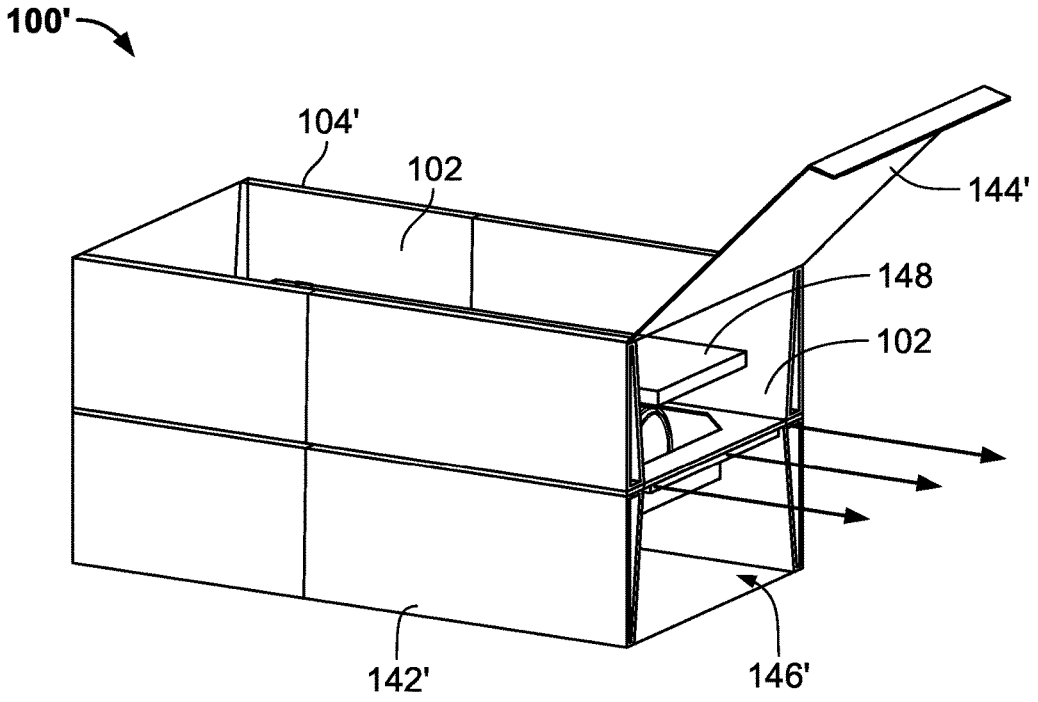
FIG. 9 is a perspective view the package of FIG. 8.

While FIGS. 4 and 5 show the package 100 as including a single subassembly 102 for the outer carton 104, where the subassembly 102 can be sized for one or a plurality of primary containers 140. For example, the subassembly 102 can be sized to store two, three, or more primary containers 140 along a longitudinal length of the subassembly 102 as shown, or a lateral width of the subassembly 102. As shown in FIGS. 6-8, an alternative package 100' can include multiple subassemblies 102, where each subassembly 102 has a longitudinal length corresponding to a single primary container 140. Accordingly, the subassemblies 102 can have differing longitudinal lengths depending on the primary containers 140 intended for the package 100. Of course, one or more of the subassemblies 102 can be configured to store multiple primary containers 140. Further, an alternative outer carton 104' of this form can be sized to receive all of the plurality of subassemblies 102 therein, where the carton 104' is sized so that the legs 118 of both supports 106 of all of the subassemblies 102 extend fully between and engage walls 142' of the outer carton 104' so that the primary containers 140 are securely suspended within the interior of the outer carton 104' with the legs 118 bracing the carton 104' internally. As shown, the legs 118 are sized to provide headspace within the outer carton 104' both above and below the primary containers 140 with the space from the walls 142' of the outer carton 104' providing additional protection for the primary containers 140. In one example, the outer carton can include end flaps 144' that can be pivoted to close off open ends 146' defined by the walls 142' of the carton 104' as commonly understood. If desired, the package 100' can also include the outsert or pamphlet 148 having information regarding the primary containers 140 or other identification information thereon, can be inserted into the outer carton 104' along with the subassembly 102.

A third example package 200 suitable for a pharmaceutical product are shown in FIGS. 10-13. The package 200 of this form includes a subassembly 202 and an outer box carton 204 sized to receive the subassembly 202 therein. The subassembly 202 includes a body 208 and a sheet of plastic 210 having ends 212 fixed to the body 208. For example, the ends 212 can be adhered to the body 208, secured with fasteners, clamped, or other suitable mechanisms.

Figure 10:
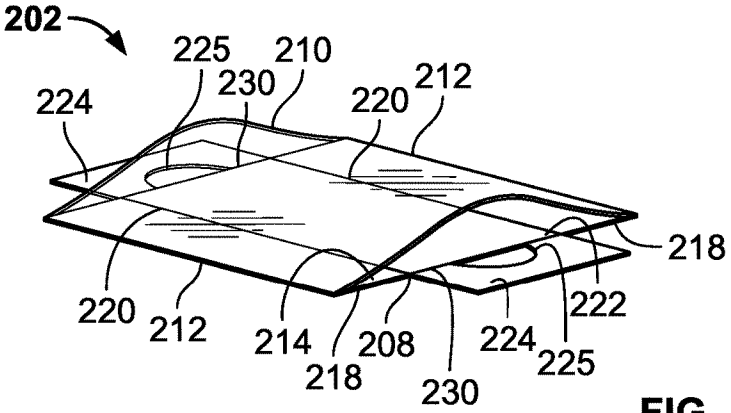
FIG. 10 is a perspective view of a fourth example subassembly for a package in a flat, storage configuration.
Figure 11:
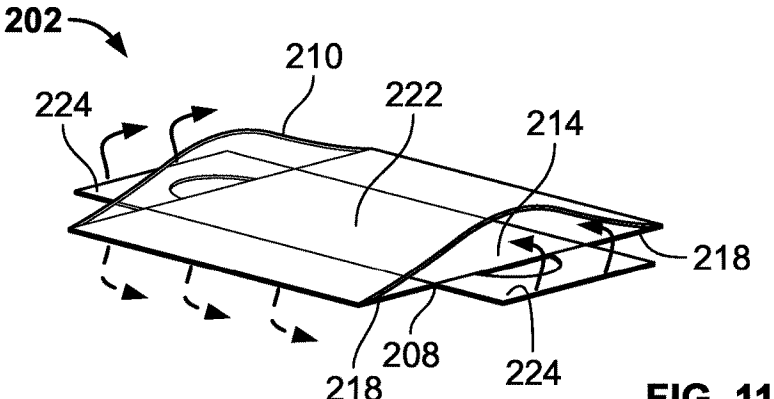
FIG. 11 is a diagrammatic view of the package of FIG. 10 showing a folding assembly therefor.
Figure 12:
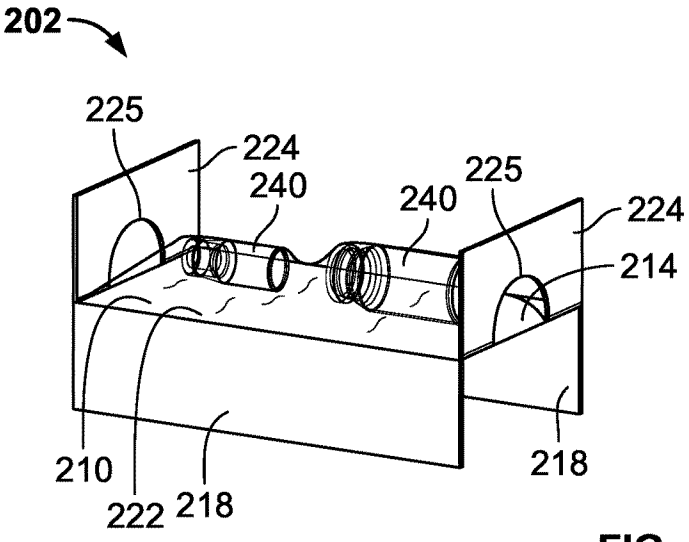
FIG. 12 is a perspective view of the subassembly of FIG. 10 in an assembled configuration.
Figure 13:
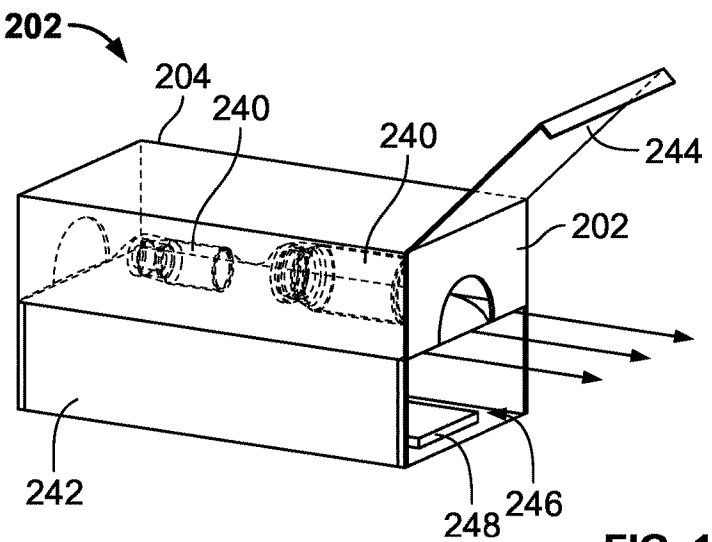
FIG. 13 is a perspective view of a third example package include the subassembly of FIG. 12 and an outer carton.
Figure 15:
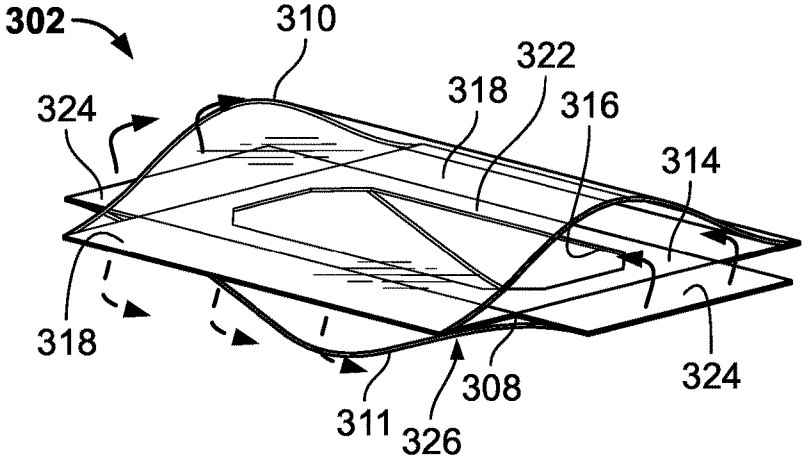
FIG. 15 is a diagrammatic view of the package of FIG. 14 showing a folding assembly therefor.

Referring to FIG. 10, the body 208 includes a main panel 214 having a planar, unbroken configuration and a pair of legs 218 extending outwardly from opposing side edges 220 of the main panel 214. The legs 218 are pivotably attached to the side edges 220 of the main panel 214 so that the legs 218 can be pivoted from a storage position where the body 208 is flat and a use configuration where the legs 218 extend downwardly from the main panel 214 away from a top face 222 thereof. In this form, the ends 212 of the sheet of plastic 210 are fixed to the legs 218 with the sheet 210 extending over the top face 222 of the main panel 214. If desired, the body 208 can further include a second pair of legs 224 that are pivotably coupled to opposing end edges 230 of the main panel 214, so that the legs 224 can be pivoted from a storage position where the body 208 is flat and a use configuration where the legs 224 extend upwardly from the main panel 214 away from a bottom face 226 thereof.

With this configuration, the sheet of plastic 210 can be sized to have a loose, loading configuration with the legs 218 pivoted above the top face 222 or, if desired, extending laterally outwardly from the main panel 214 and a tensioned configuration pulled against the top face 222 with the legs 218 pivoted downwardly relative to the main panel 214. During assembly, a user can pivot the legs 218 to put the sheet of plastic 210 in the loose, loading configuration to load one or more primary containers 240 between the sheet of plastic 210 and the main panel 214 and subsequently pivot the legs 218 downwardly to the use position, which can be a generally perpendicular position relative to the main panel 214, to tension and deform the sheet of plastic 210 over the primary containers 240 and hold the primary containers 240 in place against and relative to the main panel 214. In the illustrated example, the main panel 214 has a rectangular configuration and the main panel 214 and the sheet of plastic 210 can have the same or a similar longitudinal length so that the sheet 210 completely covers the main panel 214. The second pair of legs 224 can also be pivoted to the use position so that the legs 218, 224 extend in opposite directions above and below the main panel 214. In one form, the legs 224 can include an opening 225 extending therethrough to provide a window to view the primary containers 240 when the legs 224 are in the use position.

Thereafter, the outer carton 204 can be assembled and the subassembly 202 can be inserted into the outer carton 204. As shown, the outer carton 204 can be sized so that the legs 218, 224 combine so that the subassembly 202 extends fully between and engages walls 242 of the outer carton 204 so that the primary containers 240 are securely suspended within the interior of the outer carton 204 with the legs 218, 224 bracing the carton 204 internally. As shown, the legs 218, 224 are sized to provide headspace within the outer carton 204 both above and below the primary containers 240 with the space from the walls 242 of the outer carton 204 providing additional protection for the primary containers 240. In one example, the outer carton 204 can include end flaps 244 that can be pivoted to close off open ends 246 defined by the walls 242 of the carton 204, as commonly understood. If desired, an outsert or pamphlet 248 having information regarding the primary containers 240 or other identification information thereon, can be inserted into the outer carton 204 along with the subassembly 202.

A fourth example package 300 suitable for a pharmaceutical product are shown in FIGS. 14-17. The package 300 of this form includes a subassembly 302 and an outer box carton 304 sized to receive the subassembly 302 therein. The subassembly 302 includes a body 308 and first and second sheets of plastic 310, 311 having ends 312, 313 fixed to the body 308. For example, the ends 312, 313 can be adhered to the body 308, secured with fasteners, clamped, or other suitable mechanisms.

Figure 14:
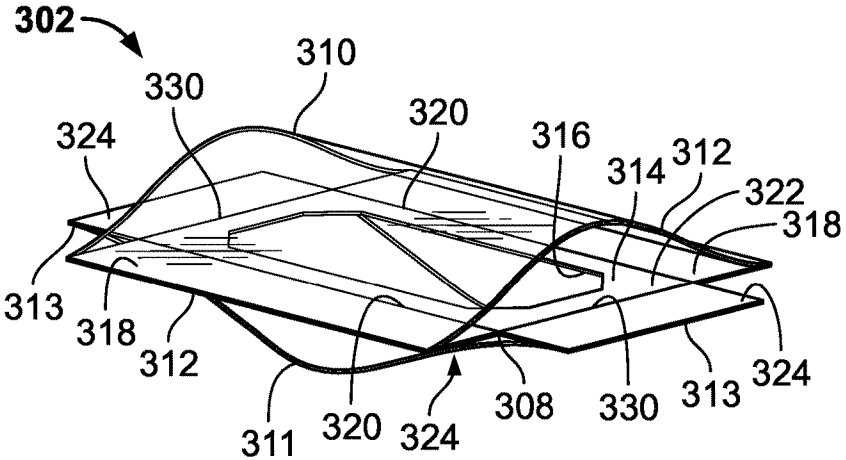
FIG. 14 is a perspective view of a fourth example subassembly for a package in a flat, storage configuration.
Figure 17:
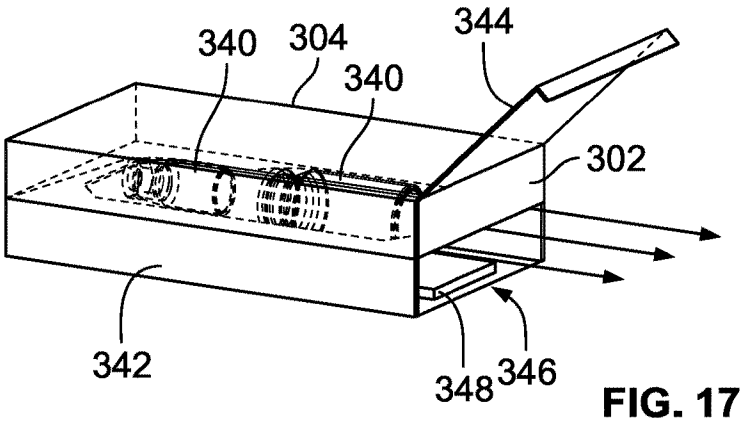
FIG. 17 is a perspective view of a third example package include the subassembly of FIG. 16 and an outer carton.
Figure 16:
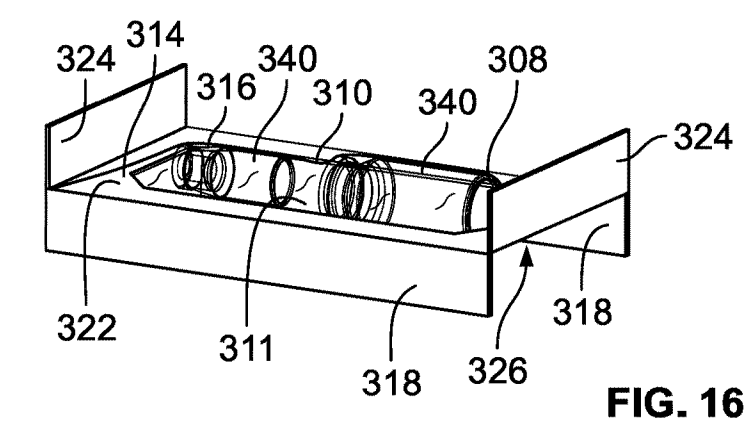
FIG. 16 is a perspective view of the subassembly of FIG. 14 in an assembled configuration.

Referring to FIG. 14, the body 308 includes a main panel 314 having a planar configuration with an opening 316 extending therethrough, a first pair of legs 318 extending outwardly from opposing side edges 320 of the main panel 314, and a second pair of legs 324 extending outwardly from opposing end edges 330 of the main panel 314. The first pair of legs 318 are pivotably attached to the side edges 320 of the main panel 314 so that the legs 318 can be pivoted from a storage position where the body 308 is flat and a use configuration where the legs 318 extend downwardly from the main panel 314 away from a top face 322 thereof. The second pair of legs 324 are pivotably attached to the end edges 330 of the main panel 314 so that the legs 324 can be pivoted from a storage position where the body 308 is flat and a use configuration where the legs 324 extend upwardly from the main panel 314 away from a bottom face 326 thereof.

In this form, the ends 312 of the first sheet of plastic 310 are fixed to the first pair of legs 318 with the sheet 310 extending over the top face 322 of the main panel 314 and the ends 313 of the second sheet of plastic 311 are fixed to the second pair of legs 324 with the sheet 311 extending over the bottom face 326 of the main panel 314. With this configuration, the first sheet of plastic 310 can be sized to have a loose, loading configuration with the first pair of legs 318 pivoted above the top face 322 or, if desired, extending laterally outwardly from the main panel 314 and a tensioned configuration pulled against the top face 322 with the legs 318 pivoted downwardly relative to the main panel 314. Further, the second sheet of plastic 311 can be sized to have a loose, loading configuration with the second pair of legs 324 pivoted below the bottom face 326 or, if desired, extending laterally outwardly from the main panel 314 and a tensioned configuration pulled against the bottom face 326 with the legs 324 pivoted upwardly relative to the main panel 314.

During assembly, a user can pivot the legs 318, 324 to put one or both of the sheets of plastic 310, 311 in the loose, loading configurations to load one or more primary containers 340 between the sheets of plastic 310, 311 within or aligned with the opening 316 in the main panel 314 and subsequently pivot the legs 318, 324 downwardly and upwardly, respectfully, to the use positions, which can be a generally perpendicular position relative to the main panel 314, to tension and deform the sheets of plastic 310, 311 over the primary containers 340 and hold the primary containers 340 in place therebetween and relative to the main panel 314. As shown, pivoting the legs 318, 324 suspends the primary containers 340 within the opening 316 of the main panel 314 generally along a centerline height of the subassembly 302. This positioning allows the height of the assembled subassembly, e.g. the length of the legs 318, 324, to be reduced relative to the above package 200, which results in a more compact package 300 with a smaller resulting outer carton 304. In the illustrated example, the main panel 314 has a rectangular configuration and the main panel 314 and the sheets of plastic 310, 311 can have the same or a similar longitudinal length as the main panel 314 so that the sheets 310, 311 completely cover the faces 322, 326 of the main panel 314.

Thereafter, the outer carton 304 can be assembled and the subassembly 302 can be inserted into the outer carton 304. As shown, the outer carton 304 can be sized so that the legs 318, 324 combine so that the subassembly 302 extends fully between and engages walls 342 of the outer carton 304 so that the primary containers 340 are securely suspended within the interior of the outer carton 304 with the legs 318, 324 bracing the carton 304 internally. As shown, the legs 318, 324 are sized to provide headspace within the outer carton 304 both above and below the primary containers 340 with the space from the walls 342 of the outer carton 304 providing additional protection for the primary containers 340. In one example, the outer carton 304 can include end flaps 344 that can be pivoted to close off open ends 346 defined by the walls 342 of the carton 304, as commonly understood. If desired, an outsert or pamphlet 348 having information regarding the primary containers 340 or other identification information thereon, can be inserted into the outer carton 304 along with the subassembly 302.

In one example, the above bodies 108, 208, 308 can be made from a fiberboard material and, if desired, the pivot connections of the subassemblies 102, 202, 302 can be scored and/or creased into the fiberboard material. The subassemblies 102, 202, 302 can be preassembled with the plastic sheets 110, 210, 310, 311 fixed, e.g., adhered, to the bodies 108, 208, 308.

In some embodiments, a volume of a drug included in the primary containers 140, 240, 340 may be equal to 1 mL, or equal to approximately (e.g., ±10%) 1 mL, or equal to 2.5 mL, or equal to approximately (e.g., ±10%) 2.5 mL, or less than or equal to approximately (e.g., ±10%) 2 mL, or less than or equal to approximately (e.g., ±10%) 3 mL, or less than or equal to approximately (e.g., ±10%) 4 mL, or less than approximately (e.g., ±10%) 5 mL, or less than or equal to approximately (e.g., ±10%) 10 mL, or within a range between approximately (e.g., ±10%) 1-10 mL, or within a range between approximately (e.g., ±10%) 1-5 mL, or within a range between approximately (e.g., ±10%) 1-4 mL, or within a range between approximately (e.g., ±10%) 1-3 mL, or within a range between approximately (e.g., ±10%) 1-2.5 mL.

It will be appreciated that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. The same reference numbers may be used to describe like or similar parts. Further, while several examples have been disclosed herein, any features from any examples may be combined with or replaced by other features from other examples. Moreover, while several examples have been disclosed herein, changes may be made to the disclosed examples within departing from the scope of the claims.

The above description describes various packages for pharmaceutical products. It should be clear that the primary containers can further include a medicament listed below with the caveat that the following list should neither be considered to be all inclusive nor limiting.

The above description describes various devices, assemblies, components, subsystems and methods for use related to a drug delivery device. The packages, primary containers, assemblies, components, subsystems, methods, or drug delivery devices can further comprise or be used with a drug including but not limited to those drugs identified below as well as their generic and biosimilar counterparts. The term drug, as used herein, can be used interchangeably with other similar terms and can be used to refer to any type of medicament or therapeutic material including traditional and non-traditional pharmaceuticals, nutraceuticals, supplements, biologics, biologically active agents and compositions, large molecules, biosimilars, bioequivalents, therapeutic antibodies, polypeptides, proteins, small molecules and generics. Non-therapeutic injectable materials are also encompassed. The drug may be in liquid form, a lyophilized form, or in a reconstituted from lyophilized form. The following example list of drugs should not be considered as all-inclusive or limiting.

In some embodiments, the primary container may be filled with colony stimulating factors, such as granulocyte colony-stimulating factor (G-CSF). Such G-CSF agents include but are not limited to Neulasta® (pegfilgrastim, pegylated filgastrim, pegylated G-CSF, pegylated hu-Met-G-CSF) and Neupogen® (filgrastim, G-CSF, hu-MetG-CSF), UDENYCA® (pegfilgrastim-cbqv), Ziextenzo® (LA-EP2006; pegfilgrastim-bmez), or FULPHILA (pegfilgrastim-bmez).

In other embodiments, the primary container may contain or be used with an erythropoiesis stimulating agent (ESA), which may be in liquid or lyophilized form. An ESA is any molecule that stimulates erythropoiesis. In some embodiments, an ESA is an erythropoiesis stimulating protein. As used herein, "erythropoiesis stimulating protein" means any protein that directly or indirectly causes activation of the erythropoietin receptor, for example, by binding to and causing dimerization of the receptor. Erythropoiesis stimulating proteins include erythropoietin and variants, analogs, or derivatives thereof that bind to and activate erythropoietin receptor; antibodies that bind to erythropoietin receptor and activate the receptor; or peptides that bind to and activate erythropoietin receptor. Erythropoiesis stimulating proteins include, but are not limited to, Epogen® (epoetin alfa), Aranesp® (darbepoetin alfa), Dynepo® (epoetin delta), Mircera® (methyoxy polyethylene glycol-epoetin beta), Hematide®, MRK-2578, INS-22, Retacrit® (epoetin zeta), Neorecormon® (epoetin beta), Silapo® (epoetin zeta), Binocrit® (epoetin alfa), epoetin alfa Hexal, Abseamed® (epoetin alfa), Ratioepo® (epoetin theta), Eporatio® (epoetin theta), Biopoin® (epoetin theta), epoetin alfa, epoetin beta, epoetin iota, epoetin omega, epoetin delta, epoetin zeta, epoetin theta, and epoetin delta, pegylated erythropoietin, carbamylated erythropoietin, as well as the molecules or variants or analogs thereof.

Among particular illustrative proteins are the specific proteins set forth below, including fusions, fragments, analogs, variants or derivatives thereof: OPGL specific antibodies, peptibodies, related proteins, and the like (also referred to as RANKL specific antibodies, peptibodies and the like), including fully humanized and human OPGL specific antibodies, particularly fully humanized monoclonal antibodies; Myostatin binding proteins, peptibodies, related proteins, and the like, including myostatin specific peptibodies; IL-4 receptor specific antibodies, peptibodies, related proteins, and the like, particularly those that inhibit activities mediated by binding of IL-4 and/or IL-13 to the receptor; Interleukin 1-receptor 1 ("IL1-R1") specific antibodies, peptibodies, related proteins, and the like; Ang2 specific antibodies, peptibodies, related proteins, and the like; NGF specific antibodies, peptibodies, related proteins, and the like; CD22 specific antibodies, peptibodies, related proteins, and the like, particularly human CD22 specific antibodies, such as but not limited to humanized and fully human antibodies, including but not limited to humanized and fully human monoclonal antibodies, particularly including but not limited to human CD22 specific IgG antibodies, such as, a dimer of a human-mouse monoclonal hLL2 gamma-chain disulfide linked to a human-mouse monoclonal hLL2 kappa-chain, for example, the human CD22 specific fully humanized antibody in Epratuzumab, CAS registry number 501423-23-0; IGF-1 receptor specific antibodies, peptibodies, and related proteins, and the like including but not limited to anti-IGF-1R antibodies; B-7 related protein 1 specific antibodies, peptibodies, related proteins and the like ("B7RP-1" and also referring to B7H2, ICOSL, B7h, and CD275), including but not limited to B7RP-specific fully human monoclonal IgG2 antibodies, including but not limited to fully human IgG2 monoclonal antibody that binds an epitope in the first immunoglobulin-like domain of B7RP-1, including but not limited to those that inhibit the interaction of B7RP-1 with its natural receptor, ICOS, on activated T cells; IL-15 specific antibodies, peptibodies, related proteins, and the like, such as, in particular, humanized monoclonal antibodies, including but not limited to HuMax IL-15 antibodies and related proteins, such as, for instance, 145c7; IFN gamma specific antibodies, peptibodies, related proteins and the like, including but not limited to human IFN gamma specific antibodies, and including but not limited to fully human anti-IFN gamma antibodies; TALL-1 specific antibodies, peptibodies, related proteins, and the like, and other TALL specific binding proteins; Parathyroid hormone ("PTH") specific antibodies, peptibodies, related proteins, and the like; Thrombopoietin receptor ("TPO-R") specific antibodies, peptibodies, related proteins, and the like; Hepatocyte growth factor ("HGF") specific antibodies, peptibodies, related proteins, and the like, including those that target the HGF/SF:cMet axis (HGF/SF:c-Met), such as fully human monoclonal antibodies that neutralize hepatocyte growth factor/scatter (HGF/SF); TRAIL-R2 specific antibodies, peptibodies, related proteins and the like; Activin A specific antibodies, peptibodies, proteins, and the like; TGF-beta specific antibodies, peptibodies, related proteins, and the like; Amyloid-beta protein specific antibodies, peptibodies, related proteins, and the like; c-Kit specific antibodies, peptibodies, related proteins, and the like, including but not limited to proteins that bind c-Kit and/or other stem cell factor receptors; OX40L specific antibodies, peptibodies, related proteins, and the like, including but not limited to proteins that bind OX40L and/or other ligands of the OX40 receptor; Activase® (alteplase, tPA); Aranesp® (darbepoetin alfa) Erythropoietin [30-asparagine, 32-threonine, 87-valine, 88-asparagine, 90-threonine], Darbepoetin alfa, novel erythropoiesis stimulating protein (NESP); Epogen® (epoetin alfa, or erythropoietin); GLP-1, Avonex® (interferon beta-1a); Bexxar® (tositumomab, anti-CD22 monoclonal antibody); Betaseron® (interferon-beta); Campath® (alemtuzumab, anti-CD52 monoclonal antibody); Dynepo® (epoetin delta); Velcade® (bortezomib); MLN0002 (anti-α4β7 mAb); MLN1202 (anti-CCR2 chemokine receptor mAb); Enbrel® (etanercept, TNF-receptor/Fc fusion protein, TNF blocker); Eprex® (epoetin alfa); Erbitux® (cetuximab, anti-EGFR/HER1/c-ErbB-1); Genotropin® (somatropin, Human Growth Hormone); Herceptin® (trastuzumab, anti-HER2/neu (erbB2) receptor mAb); Kanjinti™ (trastuzumab-anns) anti-HER2 monoclonal antibody, biosimilar to Herceptin®, or another product containing trastuzumab for the treatment of breast or gastric cancers; Humatrope® (somatropin, Human Growth Hormone); Humira® (adalimumab); Vectibix® (panitumumab), Xgeva® (denosumab), Prolia® (denosumab), Immunoglobulin G2 Human Monoclonal Antibody to RANK Ligand, Enbrel® (etanercept, TNF-receptor/Fc fusion protein, TNF blocker), Nplate® (romiplostim), rilotumumab, ganitumab, conatumumab, brodalumab, insulin in solution; Infergen® (interferon alfacon-1); Natrecor® (nesiritide; recombinant human B-type natriuretic peptide (hBNP); Kineret® (anakinra); Leukine® (sargamostim, rhuGM-CSF); LymphoCide® (epratuzumab, anti-CD22 mAb); Benlysta™ (lymphostat B, belimumab, anti-BlyS mAb); Metalyse® (tenecteplase, t-PA analog); Mircera® (methoxy polyethylene glycol-epoetin beta); Mylotarg® (gemtuzumab ozogamicin); Raptiva® (efalizumab); Cimzia® (certolizumab pegol, CDP 870); Solids™ (eculizumab); pexelizumab (anti-C5 complement); Numax® (MEDI-524); Lucentis® (ranibizumab); Panorex® (17-1A, edrecolomab); Trabio® (lerdelimumab); TheraCim hR3 (nimotuzumab); Omnitarg (pertuzumab, 2C4); Osidem® (IDM-1); Ova-Rex® (B43.13); Nuvion® (visilizumab); cantuzumab mertansine (huC242-DM1); NeoRecormon® (epoetin beta); Neumega® (oprelvekin, human interleukin-11); Orthoclone OKT3® (muromonab-CD3, anti-CD3 monoclonal antibody); Procrit® (epoetin alfa); Remicade® (infliximab, anti-TNFα monoclonal antibody); Reopro® (abciximab, anti-GP IIb/IIia receptor monoclonal antibody); Actemra® (anti-IL6 Receptor mAb); Avastin® (bevacizumab), HuMax-CD4 (zanolimumab); Mvasi™ (bevacizumab-awwb); Rituxan® (rituximab, anti-CD20 mAb); Tarceva® (erlotinib); Roferon-A®-(interferon alfa-2a); Simulect® (basiliximab); Prexige® (lumiracoxib); Synagis® (palivizumab); 145c7-CHO (anti-IL15 antibody, see U.S. Pat. No. 7,153,507); Tysabri® (natalizumab, anti-α4integrin mAb); Valortim® (MDX-1303, anti-*B. anthracis* protective antigen mAb); ABthrax™; Xolair® (omalizumab); ETI211 (anti-MRSA mAb); IL-1 trap (the Fc portion of human IgG1 and the extracellular domains of both IL-1 receptor components (the Type I receptor and receptor accessory protein)); VEGF trap (Ig domains of VEGFR1 fused to IgG1 Fc); Zenapax® (daclizumab); Zenapax® (daclizumab, anti-IL-2Ra mAb); Zevalin® (ibritumomab tiuxetan); Zetia® (ezetimibe); Orencia® (atacicept, TACI-Ig); anti-CD80 monoclonal antibody (galiximab); anti-CD23 mAb (lumiliximab); BR2-Fc (huBR3/huFc fusion protein, soluble BAFF antagonist); CNTO 148 (golimumab, anti-TNFα mAb); HGS-ETR1 (mapatumumab; human anti-TRAIL Receptor-1 mAb); HuMax-CD20 (ocrelizumab, anti-CD20 human mAb); HuMax-EGFR (zalutumumab); M200 (volociximab, anti-α5β1 integrin mAb); MDX-010 (ipilimumab, anti-CTLA-4 mAb and VEGFR-1 (IMC-18F1); anti-BR3 mAb; anti-*C. difficile* Toxin A and Toxin B C mAbs MDX-066 (CDA-1) and MDX-1388); anti-CD22 dsFv-PE38 conjugates (CAT-3888 and CAT-8015); anti-CD25 mAb (HuMax-TAC); anti-CD3 mAb (NI-0401); adecatumumab; anti-CD30 mAb (MDX-060); MDX-1333 (anti-IFNAR); anti-CD38 mAb (HuMax CD38); anti-CD40L mAb; anti-Cripto mAb; anti-CTGF Idiopathic Pulmonary Fibrosis Phase I Fibrogen (FG-3019); anti-CTLA4 mAb; anti-eotaxin1 mAb (CAT-213); anti-FGF8 mAb; anti-ganglioside GD2 mAb; anti-ganglioside GM2 mAb; anti-GDF-8 human mAb (MYO-029); anti-GM-CSF Receptor mAb (CAM-3001); anti-HepC mAb (HuMax HepC); anti-IFNα mAb (MEDI-545, MDX-198); anti-IGF1R mAb; anti-IGF-1R mAb (HuMax-Inflam); anti-IL12 mAb (ABT-874); anti-IL12/IL23 mAb (CNTO 1275); anti-IL13 mAb (CAT-354); anti-IL2Ra mAb (HuMax-TAC); anti-IL5 Receptor mAb; anti-integrin receptors mAb (MDX-018, CNTO 95); anti-IP10 Ulcerative Colitis mAb (MDX-1100); BMS-66513; anti-Mannose Receptor/hCGβ mAb (MDX-1307); anti-mesothelin dsFv-PE38 conjugate (CAT-5001); anti-PD1mAb (MDX-1106 (ONO-4538)); anti-PDGFRα antibody (IMC-3G3); anti-TGFβ mAb (GC-1008); anti-TRAIL Receptor-2 human mAb (HGS-ETR2); anti-TWEAK mAb; anti-VEGFR/Flt-1 mAb; and anti-ZP3 mAb (HuMax-ZP3).

In some embodiments, the primary container may contain or be used with a sclerostin antibody, such as but not limited to romosozumab, blosozumab, BPS 804 (Novartis), Evenity™ (romosozumab-aqqg), another product containing romosozumab for treatment of postmenopausal osteoporosis and/or fracture healing and in other embodiments, a monoclonal antibody (IgG) that binds human Proprotein Convertase Subtilisin/Kexin Type 9 (PCSK9). Such PCSK9 specific antibodies include, but are not limited to, Repatha® (evolocumab) and Praluent® (alirocumab). In other embodiments, the drug delivery device may contain or be used with rilotumumab, bixalomer, trebananib, ganitumab, conatumumab, motesanib diphosphate, brodalumab, vidupiprant or panitumumab. In some embodiments, the reservoir of the drug delivery device may be filled with or the device can be used with IMLYGIC® (talimogene laherparepvec) or another oncolytic HSV for the treatment of melanoma or other cancers including but are not limited to OncoVEXGALV/CD; OrienX010; G207, 1716; NV1020; NV12023; NV1034; and NV1042. In some embodiments, the drug delivery device may contain or be used with endogenous tissue inhibitors of metalloproteinases (TIMPs) such as but not limited to TIMP-3. In some embodiments, the drug delivery device may contain or be used with Aimovig® (erenumab-aooe), anti-human CGRP-R (calcitonin gene-related peptide type 1 receptor) or another product containing erenumab for the treatment of migraine headaches. Antagonistic antibodies for human calcitonin gene-related peptide (CGRP) receptor such as but not limited to erenumab and bispecific antibody molecules that target the CGRP receptor and other headache targets may also be delivered with a drug delivery device of the present disclosure. Additionally, bispecific T cell engager (BITE®) antibodies such as but not limited to BLINCYTO® (blinatumomab) can be used in or with the drug delivery device of the present disclosure. In some embodiments, the drug delivery device may contain or be used with an APJ large molecule agonist such as but not limited to apelin or analogues thereof. In some embodiments, a therapeutically effective amount of an anti-thymic stromal lymphopoietin (TSLP) or TSLP receptor antibody is used in or with the drug delivery device of the present disclosure. In some embodiments, the drug delivery device may contain or be used with Avsola™ (infliximab-axxq), anti-TNF α monoclonal antibody, biosimilar to Remicade® (infliximab) (Janssen Biotech, Inc.) or another product containing infliximab for the treatment of autoimmune diseases. In some embodiments, the drug delivery device may contain or be used with Kyprolis® (carfilzomib), (2S)—N—((S)-1-((S)-4-methyl-1-((R)-2-methyloxiran-2-yl)-1-oxopentan-2-ylcarbamoyl)-2-phenylethyl)-2-((S)-2-(2-morpholinoacetamido)-4-phenylbutanamido)-4-methylpentanamide, or another product containing carfilzomib for the treatment of multiple myeloma. In some embodiments, the drug delivery device may contain or be used with Otezla® (apremilast), N-[2-[(1S)-1-(3-ethoxy-4-methoxyphenyl)-2-(methylsulfonyl)ethyl]-2,3-dihydro-1,3-dioxo-1H-isoindol-4-yl]acetamide, or another product containing apremilast for the treatment of various inflammatory diseases. In some embodiments, the drug delivery device may contain or be used with Parsabiv™ (etelcalcetide HCl, KAI-4169) or another product containing etelcalcetide HCl for the treatment of secondary hyperparathyroidism (sHPT) such as in patients with chronic kidney disease (KD) on hemodialysis. In some embodiments, the drug delivery device may contain or be used with ABP 798 (rituximab), a biosimilar candidate to Rituxan®/MabThera™ or another product containing an anti-CD20 monoclonal antibody. In some embodiments, the drug delivery device may contain or be used with a VEGF antagonist such as a non-antibody VEGF antagonist and/or a VEGF-Trap such as aflibercept (Ig domain 2 from VEGFR1 and Ig domain 3 from VEGFR2, fused to Fc domain of IgG1). In some embodiments, the drug delivery device may contain or be used with ABP 959 (eculizumab), a biosimilar candidate to Soliris®, or another product containing a monoclonal antibody that specifically binds to the complement protein C5. In some embodiments, the drug delivery device may contain or be used with Rozibafusp alfa (formerly AMG 570) is a novel bispecific antibody-peptide conjugate that simultaneously blocks ICOSL and BAFF activity. In some embodiments, the drug delivery device may contain or be used with Omecamtiv mecarbil, a small molecule selective cardiac myosin activator, or myotrope, which directly targets the contractile mechanisms of the heart, or another product containing a small molecule selective cardiac myosin activator. In some embodiments, the drug delivery device may contain or be used with Sotorasib (formerly known as AMG 510), a $KRAS^{G12C}$ small molecule inhibitor, or another product containing a $KRAS^{G12C}$ small molecule inhibitor. In some embodiments, the drug delivery device may contain or be used with Tezepelumab, a human monoclonal antibody that inhibits the action of thymic stromal lymphopoietin (TSLP), or another product containing a human monoclonal antibody that inhibits the action of TSLP. In some embodiments, the drug delivery device may contain or be used with AMG 714, a human monoclonal antibody that binds to Interleukin-15 (IL-15) or another product containing a human monoclonal antibody that binds to Interleukin-15 (IL-15). In some embodiments, the drug delivery device may contain or be used with AMG 890, a small interfering RNA (siRNA) that lowers lipoprotein(a), also known as Lp(a), or another product containing a small interfering RNA (siRNA) that lowers lipoprotein(a). In some embodiments, the drug delivery device may contain or be used with ABP 654 (human IgG1 kappa antibody), a biosimilar candidate to Stelara®, or another product that contains human IgG1 kappa antibody and/or binds to the p40 subunit of human cytokines interleukin (IL)-12 and IL-23. In some embodiments, the drug delivery device may contain or be used with Amjevita™ or Amgevita™ (formerly ABP 501) (mab anti-TNF human IgG1), a biosimilar candidate to Humira®, or another product that contains human mab anti-TNF human IgG1. In some embodiments, the drug delivery device may contain or be used with AMG 160, or another product that contains a half-life extended (HLE) anti-prostate-specific membrane antigen (PSMA) x anti-CD3 BiTE® (bispecific T cell engager) construct. In some embodiments, the drug delivery device may contain or be used with AMG 119, or another product containing a delta-like ligand 3 (DLL3) CART (chimeric antigen receptor T cell) cellular therapy. In some embodiments, the drug delivery device may contain or be used with AMG 119, or another product containing a delta-like ligand 3 (DLL3) CAR T (chimeric antigen receptor T cell) cellular therapy. In some embodiments, the drug delivery device may contain or be used with AMG 133, or another product containing a gastric inhibitory polypeptide receptor (GIPR) antagonist and GLP-1R agonist. In some embodiments, the drug delivery device may contain or be used with AMG 171 or another product containing a Growth Differential Factor 15 (GDF15) analog. In some embodiments, the drug delivery device may contain or be used with AMG 176 or another product containing a small molecule inhibitor of myeloid cell leukemia 1 (MCL-1). In some embodiments, the drug delivery device may contain or be used with AMG 199 or another product containing a half-life extended (HLE) bispecific T cell engager construct (BITE®). In some embodiments, the drug delivery device may contain or be used with AMG 256 or another product containing an anti-PD-1 x IL21 mutein and/or an IL-21 receptor agonist designed to selectively turn on the Interleukin 21 (IL-21) pathway in programmed cell death-1 (PD-1) positive cells. In some embodiments, the drug delivery device may contain or be used with AMG 330 or another product containing an anti-CD33 x anti-CD3 BiTE® (bispecific T cell engager) construct. In some embodiments, the drug delivery device may contain or be used with AMG 404 or another product containing a human anti-programmed cell death-1 (PD-1) monoclonal antibody being investigated as a treatment for patients with solid tumors. In some embodiments, the drug delivery device may contain or be used with AMG 427 or another product containing a half-life extended (HLE) anti-fms-like tyrosine kinase 3 (FLT3) x anti-CD3 BiTE® (bispecific T cell engager) construct. In some embodiments, the drug delivery device may contain or be used with AMG 430 or another product containing an anti-Jagged-1 monoclonal antibody. In some embodiments, the drug delivery device may contain or be used with AMG 506 or another product containing a multi-specific FAP x 4-1BB-targeting DARPin® biologic under investigation as a treatment for solid tumors. In some embodiments, the drug delivery device may contain or be used with AMG 509 or another product containing a bivalent T-cell engager and is designed using XmAb® 2+1 technology. In some embodiments, the drug delivery device may contain or be used with AMG 562 or another product containing a half-life extended (HLE) CD19 x CD3 BiTE® (bispecific T cell engager) construct. In some embodiments, the drug delivery device may contain or be used with Efavaleukin alfa (formerly AMG 592) or another product containing an IL-2 mutein Fc fusion protein. In some embodiments, the drug delivery device may contain or be used with AMG 596 or another product containing a CD3 x epidermal growth factor receptor vIII (EGFRvIII) BiTE® (bispecific T cell engager) molecule. In some embodiments, the drug delivery device may contain or be used with AMG 673 or another product containing a half-life extended (HLE) anti-CD33 x anti-CD3 BiTE® (bispecific T cell engager) construct. In some embodiments, the drug delivery device may contain or be used with AMG 701 or another product containing a half-life extended (HLE) anti-B-cell maturation antigen (BCMA) x anti-CD3 BiTE® (bispecific T cell engager) construct. In some embodiments, the drug delivery device may contain or be used with AMG 757 or another product containing a half-life extended (HLE) anti-delta-like ligand 3 (DLL3) x anti-CD3 BiTE® (bispecific T cell engager) construct. In some embodiments, the drug delivery device may contain or be used with AMG 910 or another product containing a half-life extended (HLE) epithelial cell tight junction protein claudin 18.2 x CD3 BiTE® (bispecific T cell engager) construct.

Although the packages, primary containers, drug delivery devices, assemblies, components, subsystems and methods have been described in terms of exemplary embodiments, they are not limited thereto. The detailed description is to be construed as exemplary only and does not describe every possible embodiment of the present disclosure. Numerous alternative embodiments could be implemented, using either current technology or technology developed after the filing date of this patent that would still fall within the scope of the claims defining the invention(s) disclosed herein.

Those skilled in the art will recognize that a wide variety of modifications, alterations, and combinations can be made with respect to the above described embodiments without departing from the spirit and scope of the invention(s) disclosed herein, and that such modifications, alterations, and combinations are to be viewed as being within the ambit of the inventive concept(s).

What is claimed is:

1. A package for a pharmaceutical product, the package comprising:

a subassembly comprising:

a body including a main panel and legs depending downwardly from opposite edges of the main panel, the main panel defining an opening extending therethrough;

a sheet of plastic having opposite ends fixed to the body with the sheet of plastic at least partially extending over the main panel and the opening thereof, the sheet of plastic configured to be tensioned over and deformed around one or more primary containers to hold the one or more primary containers in place relative to the main panel of the body;

wherein the body and the sheet of plastic comprise a support of the subassembly, the subassembly including two supports, wherein the two supports are configured to be coupled together with the main panels extending along each other such that the one or more primary containers are disposed within the openings defined in their respective main panels and trapped between the sheets of plastic;

wherein each of the bodies of the two supports includes a wing extending from the main panel having a tab portion and at least one slot opening, wherein the two supports are configured to interlock such that the tab portion of one wing is configured to be inserted into the at least one slot opening of the other of the two supports.

2. The package of claim 1, wherein the legs are pivotably coupled to the main panel, such that the body has a flat, storage configuration.

3. The package of claim 1, wherein the legs include proximal and distal portions pivotable with respect to one another with the distal portions pivoted under the main panel in an assembled configuration, and the at least one slot opening extends through the distal portion.

4. The package of claim 1, further comprising an outer carton sized to receive the subassembly therein, the legs configured to engage the outer carton to suspend the one or more primary containers in an interior of the outer carton.

5. The package of claim 1, wherein the subassembly comprises a first subassembly, and further comprising a second subassembly, the first and second subassemblies having different longitudinal lengths configured for primary containers having different sizes, the package further comprising an outer carton sized to receive the first and second subassemblies therein, the legs of the first and second subassemblies configured to engage the outer carton to suspend the primary containers in an interior of the outer carton.

6. The package of claim 1, wherein the ends of the sheet of plastic are fixed to the legs, and the legs are pivotably attached to the main panel, such that pivoting the legs tensions the sheet of plastic over the main panel to hold the one or more primary containers in place relative to the main panel of the body.

7. The package of claim 6, wherein the main panel has an unbroken configuration, such that pivoting the legs tensions the sheet of plastic over the main panel to hold the one or more primary containers in place against the main panel, wherein the legs comprise a first pair of legs pivotably coupled to side edges of the main panel, the body further comprises a second pair of legs pivotably coupled to end edges of the main panel, and the package further comprises an outer carton, where the first and second pairs of legs extend in opposite directions to engage the outer carton to suspend the one or more primary containers in an interior of the outer carton.

8. The package of claim 6, wherein the legs comprise a first pair of legs pivotably coupled to side edges of the main panel, the body further comprises a second pair of legs pivotably coupled to end edges of the main panel, the main panel defines an opening extending therethrough, and further comprising a second sheet of plastic having opposite ends fixed to the second pair of legs, the first and second sheets of plastic extending on opposite sides of the main panel, such that the first and second pairs of legs are configured to be pivoted towards opposite sides of the main panel to tension the first and second sheets over the main panel and trap the one or more primary containers within the opening defined in the main panel between the first and second sheets of plastic.

9. A method of assembly of a package for a pharmaceutical product, the method comprising:

providing two supports of a subassembly of the package, each of the two supports comprising:

a body including a main panel having an opening extending therethrough and legs depending downwardly from opposite edges of the main panel; and a sheet of plastic having opposite ends fixed to the body with the sheet of plastic extending over the opening of the main panel;

disposing one or more primary containers on the sheet of plastic of one of the two supports aligned within the opening of the main panel;

coupling the two supports together with the main panels extending along one another such that the one or more primary containers are disposed within the openings defined in the main panels and trapped between the sheets of plastic;

wherein the bodies of the two supports each include a wing extending from the main panel having a tab portion, and at least one slot opening, and coupling the two supports together comprises interlocking the two supports by inserting the tab portion of one of the two supports into the at least one slot opening of the other of the two supports.

10. The method of claim 9, wherein the legs include proximal and distal portions pivotable with respect to one another, the distal portion including the slot opening; and further comprising pivoting the distal portions of the legs to extend toward the main panel.

11. The method claim 9, further comprising inserting the subassembly into an outer carton of the package so that the legs engage the outer carton to suspend the one or more primary containers in an interior of the outer carton.

12. The method of claim 9, further comprising:

providing two supports of a second subassembly of the package, each of the two supports comprising:

a body including a main panel having an opening extending therethrough and legs depending downwardly from opposite edges of the main panel; and a sheet of plastic having opposite ends fixed to the body with the sheet of plastic extending over the opening of the main panel;

disposing one or more primary containers on the sheet of plastic of one of the two supports of the second subassembly aligned within the opening of the main panel;

coupling the two supports of the second subassembly together with the main panels extending along one another such that the one or more primary containers are disposed within the openings defined in the main panels and trapped between the sheets of plastic.

13. The method of claim 9, further comprising:

pivoting the legs to a storage position depending downwardly from the main panel to tension the sheet of plastic over the main panel to hold the one or more primary containers in place relative to the main panel of the body.

14. The method of claim 13, wherein the main panel has an unbroken configuration, such that pivoting the legs tensions the sheet of plastic over the main panel to hold the one or more primary containers in place against the main panel.

15. The method of claim 13, wherein the legs comprise a first pair of legs pivotably coupled to side edges of the main panel, the body further comprises a second pair of legs pivotably coupled to end edges of the main panel, the main panel defines an opening extending therethrough, and the subassembly further comprises a second sheet of plastic having opposite ends fixed to the second pair of legs, the first and second sheets of plastic extending on opposite sides of the main panel, the method further comprising pivoting the second pair of legs to a storage position extending upwardly from the main panel to tension the second sheet of plastic over the main panel to trap the one or more primary containers within the opening defined in the main panel between the first and second sheets of plastic.

16. The method of claim 13, further comprising inserting the subassembly into an outer carton.

* * * * *